US005096337A

United States Patent [19]

Denton

[11] Patent Number: 5,096,337

[45] Date of Patent: Mar. 17, 1992

[54] DEVICE FOR HANDLING LOOSE FILL FOAM PACKING

[76] Inventor: John F. Denton, 1312 Beacon Hill La., Knoxville, Tenn. 37919

[21] Appl. No.: 586,245

[22] Filed: Sep. 21, 1990

[51] Int. Cl.[5] ..... B65G 53/14

[52] U.S. Cl. ..... 406/105; 406/38; 406/151; 406/171

[58] Field of Search ..... 406/38, 105, 151, 153, 406/171, 113

[56] References Cited

U.S. PATENT DOCUMENTS

| | | | |
|---|---|---|---|
| 993,180 | 5/1911 | Leaphart | 406/38 |
| 1,047,164 | 12/1912 | Butenschoen | 406/38 |
| 3,872,539 | 3/1975 | Doyel | 15/344 |
| 4,644,606 | 2/1987 | Luerken et al. | 15/344 X |
| 5,000,623 | 3/1991 | Kihlström | 406/153 X |

*Primary Examiner*—Margaret A. Focarino
*Assistant Examiner*—Andrew C. Pike
*Attorney, Agent, or Firm*—Pitts and Brittian

[57] ABSTRACT

A device achieves the entrainment of ultralight loose fill packing materials in an air stream to transport the packing materials into a depository for reuse or disposal. The device has an elongated air flow duct, with relatively low air flow induced by a rotating fan blade that extends partially into the interior of the duct. The construction provides for the air flow into the duct to be equal to the air flow out of the duct. A screen surrounds the fan blade to prevent contact with the packing materials as they flow through the duct. The collected packing materials are deposited into a flexible plastic bag, for example, that can be releasably secured to a perforated shroud on the outlet end portion of the transport duct. This device readily removes the loose fill packing materials from shipping cartons or, in the alternative, can recover widely scattered pieces of the material. In the preferred embodiment, the area of the gap between the duct wall and the surface of the screen within the duct should be one-half (or greater) the area of the duct to prevent clogging of the duct by the packing materials.

15 Claims, 3 Drawing Sheets

DEVICE FOR HANDLING LOOSE FILL FOAM PACKING

DESCRIPTION

1. Technical Field

This invention relates to fluid current transport devices, and more particularly to a device that induces air flow from an input end to an output end for the transport of loose fill foam elements that are used for the protective packing of many types of products during shipping.

2. Background Art

Loose fill plastic foam (typically expanded rigid polystyrene e.g., STYROFOAM) elements are utilized extensively as protective packing for a large number of products during shipment thereof. These foam elements are commonly referred to as "peanuts", "popcorn", etc. Generally they are known as "loose fill foam packing". Typical of the products where this type of packing is utilized are books, electronic equipment, etc.

When packages containing loose fill foam packing are opened the packing, since it is extremely light, often scatter about. Further, since they have or create static electricity, some tend to stick to the product being shipped. In either event, the problem of handling the loose packing creates a problem. If the foam pieces are scattered on the floor, for example, they are difficult to sweep due to their extremely low density such that movement of a brush or broom tends to further scatter them. When retrieved by sweeping the pieces are often mixed with floor dirt such that they cannot be reused. Even when recovered by any known technique they must be put into some storage container for reuse: their light weight causes difficulty in this transfer.

The following references located during a preliminary patent search may be pertinent to the present invention: U.S. Pat. Nos. 1,047,164 issued to G. Butenschoen on Dec. 17, 1912; 1,182,118 issued to J. Z. Tow, et al, on May 9, 1916; 3,306,672 issued to J. E. Kleiner, et al, on Feb. 28, 1967; 3,378,309 issued to R. D. Copley, et al, on Apr. 16, 1968; 4,249,839 issued to J. E. Vance on Feb. 10, 1981; 4,325,163 issued to C. A. Mattson, et al, on Apr. 20, 1982; 4,615,069 issued to B. Henning on Oct. 7, 1986; and 4,644,606 issued to A. Luerken, et al, on Feb. 24, 1987. In these references where an "induced" air flow is utilized, the air is drawn at least partially from a source other than through the inlet to a transport duct. Relatively high air flows exist in these devices, and several have configurations that would be easily clogged with the loose fill packing materials.

OBJECTS OF THE INVENTION

Accordingly, it is an object of the present invention to provide a device for the handling of the loose fill packing materials such that they are easily recovered for reuse with a minimum contamination of other materials.

It is another object of the present invention to provide what is essentially a hand-held vacuum system for the handling of loose fill packing materials to transfer the packing from a pickup end of the system to an outlet end for the collection of the loose fill packing so as to be reused or discarded conveniently.

Another object of the present invention is to provide a hand-held handling system for loose fill packing materials that creates air flow within a transfer duct by partially inserting a fan means within the transfer duct so as to pick up the packing material and transfer the same into a collection bag or the like.

A further object of the present invention is to provide a device for the pick up of loose fill packing materials for disposal into a collection bag wherein the air flowing into the device with the materials is equal to the air flowing into the bag , with this air flow being sufficiently low to prevent redispersal of the loose fill packing materials.

It is also an object of the present invention to provide a device for the transport of loose fill packing materials which has a transport tube of sufficient size and of reduced obstructions to flow so as to prevent clogging of the transport tube.

These and other objects of the present invention will become apparent upon a consideration of the drawings referred to hereinafter and to a complete description thereof that follows.

SUMMARY OF THE INVENTION

In accordance the present invention, there is provided a transfer duct having an input end portion and an outlet end portion. A paddle-type fan means partially projects into this transfer duct which, when operating, induces air flow from the input end portion to the outlet end portion such that loose fill foam packing elements are drawn into the duct and transferred to the outlet end portion. Typically, a collection bag is positioned in communication with the outlet end portion to receive the loose fill foam packing elements. The air flow into the duct equals the air flow out of the outlet end portion. In this way, the velocity of the air can be kept low to facilitate the collection of these very low density elements. In this way, the loose foam packing elements can be "vacuumed" from a packing container prior to the removal of the items being shipped. Also, if the packing elements become scattered, they can be readily collected for reuse or for disposal.

BRIEF DESCRIPTION OF THE DRAWINGS

FIGS. 2–4 are enlarged relative to the size shown in FIG. 1 to better illustrate elements of the present invention.

BEST MODE FOR CARRYING OUT THE INVENTION

Figure 1:
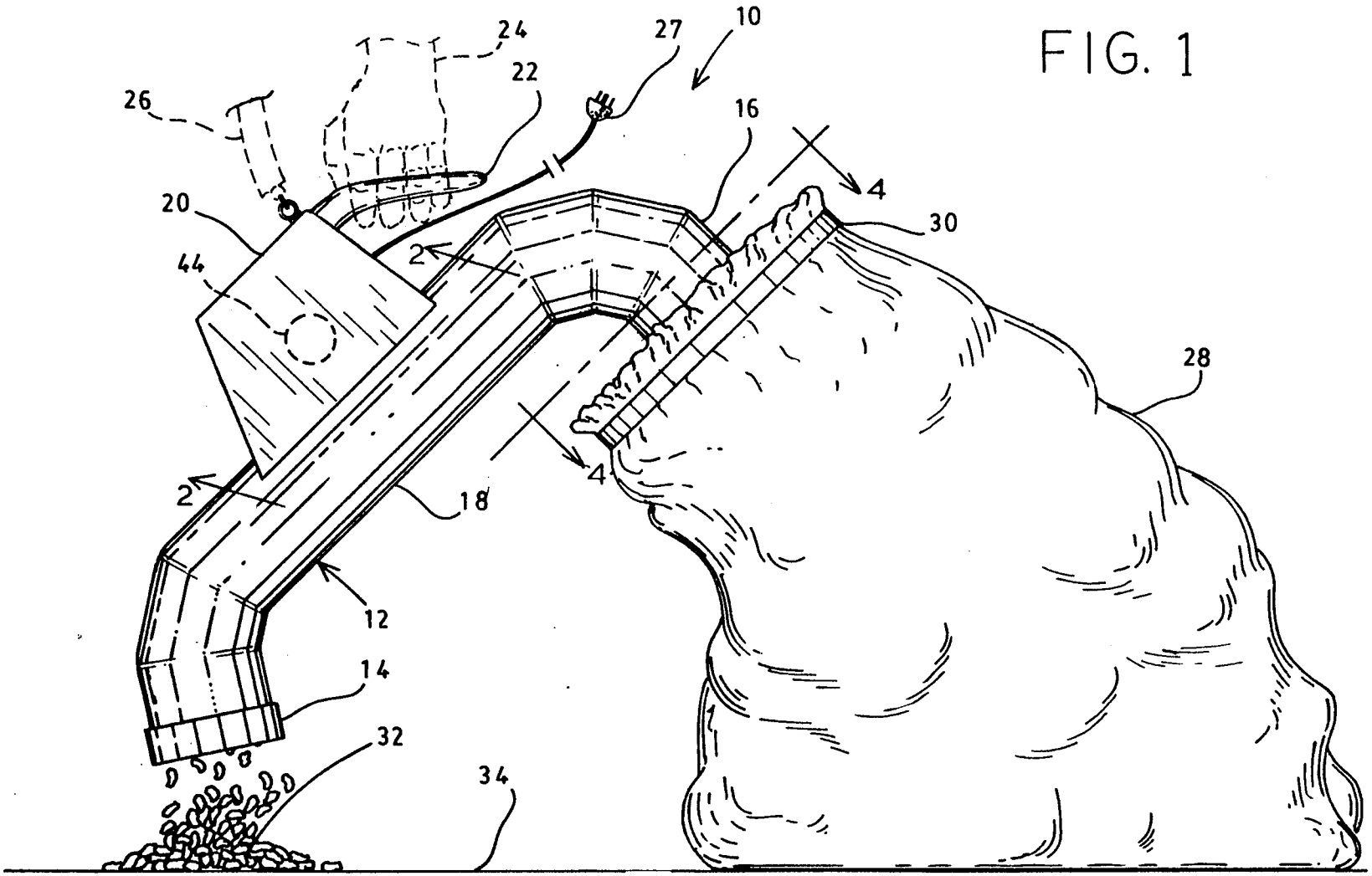
FIG. 1 is a side elevational view of a loose foam packing transfer device according to the present invention.

Referring now to FIG. 1, shown generally at 10 therein is a side elevational view of one embodiment of the present invention. In this embodiment there is a transport duct 12 which can have any desired cross section; however, as evident from FIGS. 2–4, one typical cross section is circular. The duct 12 has an inlet end portion 14, an outlet end portion 16, and a central portion 18. Although not required, the inlet and outlet end portions can have an angular relationship to the central portion as shown as long as this angular relationship does not create an impediment to flow of the loose fill packing materials. Attached to the duct 12 is a motorfan housing 20, and typically attached thereto is a handle 22 for grasping by the hand of a user 24. If desired, a shoulder strap 26 can be provided; however, for most applications of the present invention this strap probably will not be necessary. Power for drive means 44 is typically supplied by an electrical cable 27, and a switch means (not shown) is typically mounted in the wall of the housing 20.

Releasably attached to the outlet end portion 16 of the duct 12 is a collection bag 28, such as a conventional plastic "trash" bag. As will be discussed with regard to FIG. 4, this bag is typically secured to a perforated shroud with a band 30.

In this FIG. 1 is illustrated the pickup of loose fill packing 32 from a support surface, such as the floor 34. It will be understood, however, the most useful application of the present invention is to remove the loose fill packing materials directly from a shipping container even before the removal of a shipped product from the container.

Figure 2:
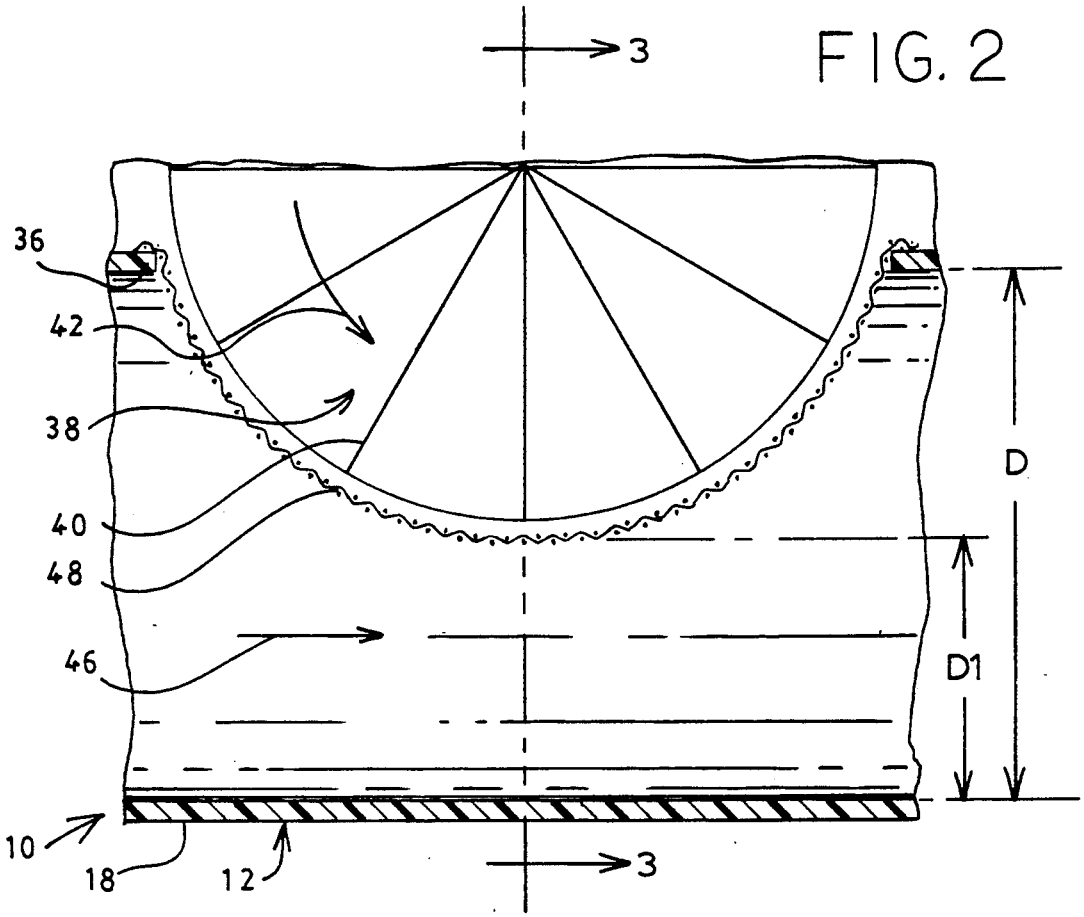
FIG. 2 is a partial longitudinal cross section of the device of FIG. 1 taken at 2—2 therein.

An enlarged partial longitudinal cross section of the present invention is illustrated in FIG. 2. This shows that the central portion 18 of the duct 12 is provided with a top opening indicated at 36. Of course, this opening could be in the side of the duct as well as on the bottom thereof. Projecting through this opening and partially into the duct 12 is a fan blade 38 having a plurality of paddle-type vanes 40. When the fan blade 38 is caused to rotate in a direction indicated by the arrow 42, as by a drive means 44 (see FIG. 1), air flow is caused to be induced through the duct 12 in a direction indicated by the arrow 46. Due to the ultralight nature of the packing elements, this induced flow can be relatively slow. This construction provides that the air flow into the inlet end portion 14 of the duct 12 is exactly equal to air flow out of the outlet end portion 16. In order to prevent contact between the loose fill packing particles and the fan components, a screen member 48 is installed so as to be substantially concentric with the periphery of the fan blade 38.

It has been found that if the fan blade 38 and the screen 48 protrude excessively into the duct 12, loose fill packing particles will clog the gap between the screen and the duct wall. In FIG. 2 this gap is indicated as D1, while the total internal dimension of the duct 12 is indicated as D. Empirically it was found that if the area in the gap, D1, for a four inch round duct (approximately twelve and one-half square inches), is equal to or greater than about six square inches, no clogging will occur. Clogging was observed in a four inch round when the area was reduced to about four and one-quarter square inches. In a three inch diameter round duct clogging was observed at three and one-third square inches. Thus, for this size of duct (four inch diameter), D1 should be about one-half D, or greater. For smaller or larger duct, of course, the free area needs to remain at least this large, at least for the sizes of loose packing elements currently in use.

Figure 3:
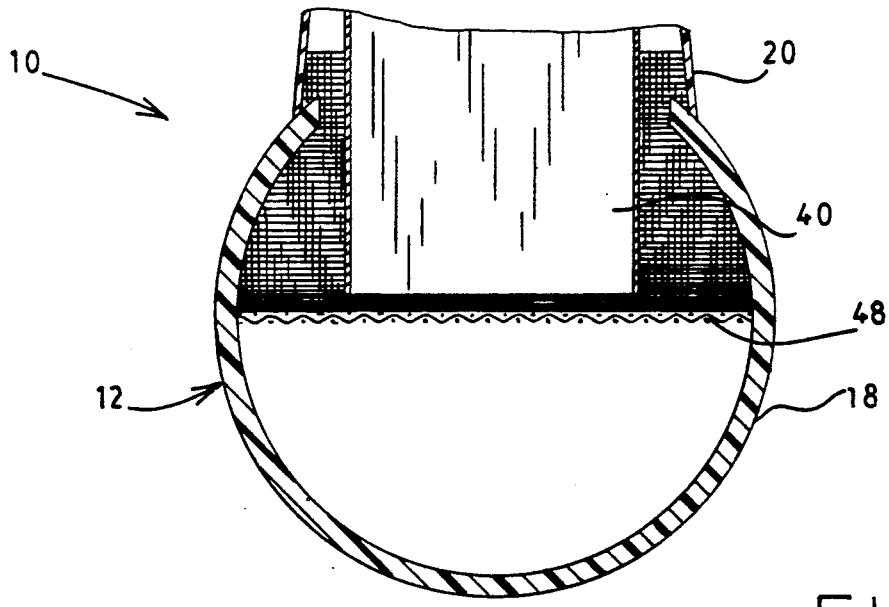
FIG. 3 is a partial transverse cross section of the device of FIG. 1 taken at 3—3 of FIG. 2.

An enlarged transverse cross section of the present invention at the center of the rotation for the fan blade 38 is illustrated in FIG. 3. It can be seen that the screen 48 extends across the duct 12 to assure absence of contact between the fan blade paddles 40 and any loose fill packing particles flowing through the duct. This drawing further illustrates the housing 20 which covers the fan blade 38 and the drive means 44 (not shown).

Figure 4:
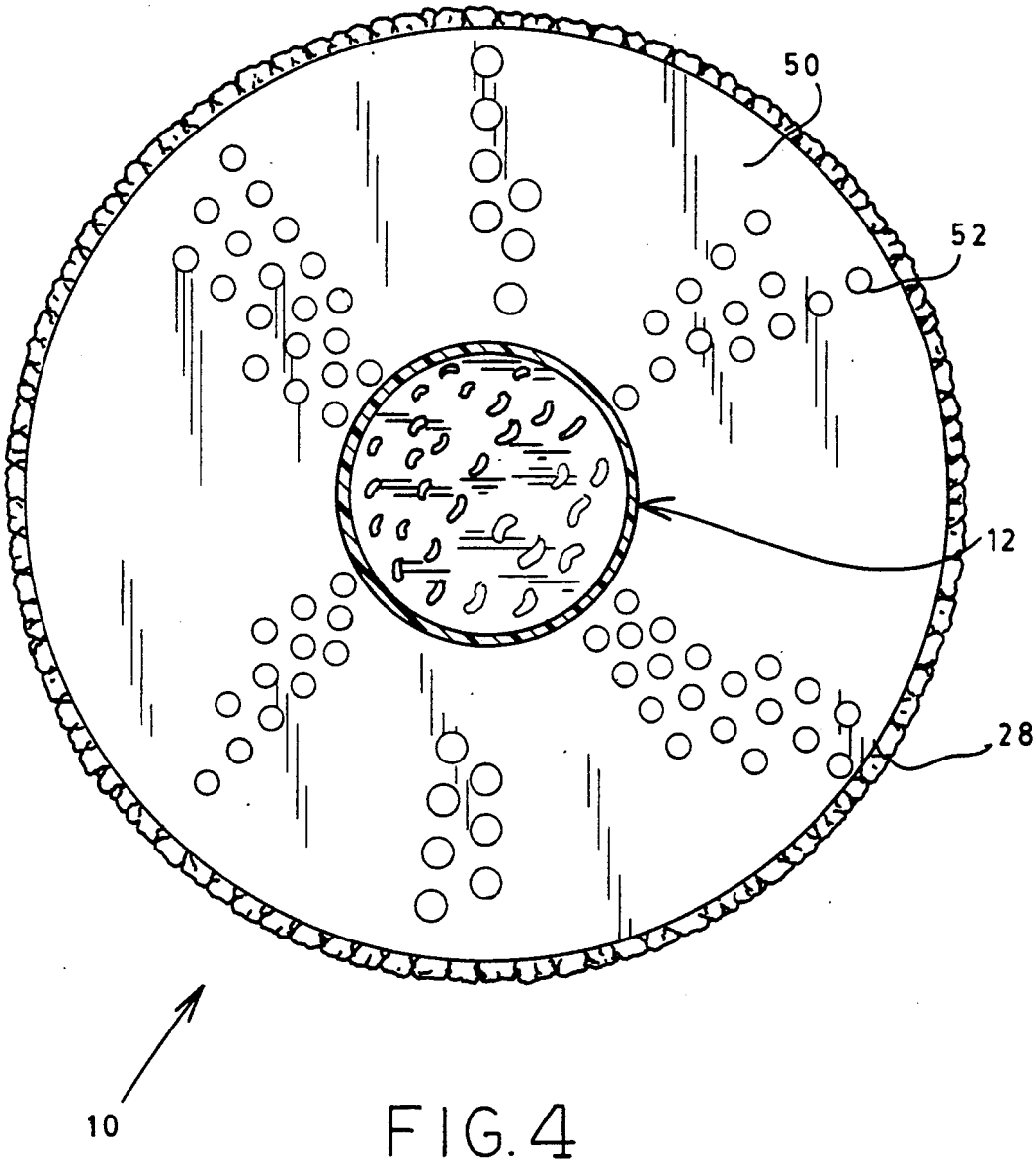
FIG. 4 is a transverse cross section of the device of FIG. 1 taken at 4—4 therein.

As stated above, the velocity of air through the duct 12 can be very low (and is rather low due to the paddle-type fan blades that are used). Accordingly, collection of the loose packing elements is relatively simple. In order to do so, a shroud 50 is affixed to the outlet end portion 16 of the duct 12 as illustrated in the enlargement of FIG. 4. Any type of collection device can be releasably attached to this shroud, such as a plastic garbage bag 28. This shroud 50 is provided with a plurality of perforations 52 such that the loose fill packing elements are retained in the bag, and the air is released to the atmosphere through these perforations. Due to the slow air flow, the packing materials do not clog the perforations 52. In this way the loose fill packing elements are collected for reuse or for disposal. Since the packing materials are already in a disposable container, no further transfer is required.

As discussed above, the present invention will typically be used to remove the ultralight loose fill packing materials from cartons, etc. that contain the same for the physical protection of material that has been shipped in the cartons. The device will normally be hand held, such that the inlet end portion 14 can be directed against the packing to cause the same to be transferred into the bag 28. This transfer can then continue, if desired or necessary, as the shipped articles are removed so as to keep under control the packing to prevent unwanted escape. This also will cause small pieces of packing that might otherwise cling to the articles to be removed. When any packing materials have been spilled around the carton, the device of the present invention can be used to recapture the packing. Since all of the packing is retained within the bag 28, it can be stored for future re-use, or the bag can be closed for disposal without redispersement of the packing.

From the foregoing it can be seen that a very practical device has been developed for the handling of the ultralight loose fill packing materials. Due to the relatively slow air velocity through the device, the transported packing materials are easily separated from the transport air. While certain sizes and configurations are given, these are not as a limitation of the invention. The invention is to be limited only by the appended claims and their equivalents with read with the above detailed description of the invention.

I claim:

1. A device for transport of ultralight loose fill packing material, said device comprising:

a transport duct defined by a peripheral wall, wherein said duct has an inlet end portion, an outlet end portion, and a central portion joining said inlet end portion with said outlet end portion, and a length defined from said inlet end portion through said central portion to said outlet end portion, wherein said duct has a cross section which is essentially constant throughout said length, and wherein said central portion has an opening in said wall; and a rotatably driven fan blade means, which is mounted to said duct and which projects through said opening, for inducing an induced air flow through said duct from said inlet end portion to said outlet end portion to transport said material, wherein air flow into said inlet end portion is equal to air flow out of said outlet end portion;

wherein said fan blade means extends into said duct a distance to establish said induced air flow without permitting clogging of said duct by said material flowing through said duct.

2. The device of claim 1 further comprising a screen means within said duct, said screen means contoured so as to be substantially concentric with said fan blade means so as to not interfere with said induced air flow but prevent contact of said loose fill packing material with said fan blade means.

3. The device of claim 1 wherein said cross section of said duct is circular and is at least four inches in diameter.

4. The device of claim 3 wherein said fan blade means extends into said duct said distance to define a gap between said fan blade means and said wall of said duct of at least six square inches, with said fan blade means extending into said duct said distance no greater than two inches.

5. The device of claim 1 wherein said fan blade means is substantially enclosed in a housing means attached to an exterior surface of said duct.

6. The device of claim 5 further comprising a handle means attached to said housing means for grasping by a user of said device.

7. The device of claim 1 further comprising:

a shroud means attached to said outlet end portion of said duct, said shroud means provided with a plurality of perforations; and a collection means releasably attached to said shroud means for retaining said loose fill packing material as separated from said induced air flow flowing through said perforations in said shroud.

8. A device for transport of ultralight loose fill packing material, said device comprising:

a transport duct defined by a cylindrical peripheral wall, wherein said duct has an inlet end portion, an outlet end portion, and a central portion joining said inlet end portion with said outlet end portion, and a length defined from said inlet end portion through said central portion to said outlet end portion, wherein said duct has a cross section which is essentially constant throughout said length, and wherein said central portion has an opening in said wall;

a rotatably driven fan blade means, which is mounted to said duct and which projects through said opening, for inducing an induced air flow through said duct from said inlet end portion to said outlet end portion to transport said loose fill packing material, wherein air flow into said inlet end portion is equal to air flow out of said outlet end portion;

a shroud means attached to said outlet end portion of said duct, said shroud means provided with a plurality of perforations; and a collection means releasably attached to said shroud means for retaining said loose fill packing material as separated from said induced air flow flowing through said perforations in said shroud;

wherein said fan blade means extends into said duct a distance to establish said induced air flow without permitting clogging of said duct by said loose fill packing material flowing through said duct.

9. The device of claim 8 wherein said cross section of said duct is circular and is at least four inches in diameter.

10. The device of claim 9 wherein said fan blade means extends into said duct said distance to define a gap between said fan blade means and said wall of said duct of at least six square inches, with said fan blade means extending into said duct said distance no greater than two inches.

11. The device of claim 8 wherein said fan blade means is substantially enclosed in a housing means attached to an exterior surface of said duct.

12. The device of claim 11 further comprising a handle means attached to said housing means for grasping by a user of said device.

13. The device of claim 8 further comprising a screen means within said duct, said screen means contoured so as to be substantially concentric with said fan blade means so as to prevent contact of said loose fill packing material with said fan blade means but not interfere with said induced air flow through said duct.

14. A device for transport of ultralight loose fill packing material, said device comprising:

a transport duct defined by a cylindrical peripheral wall of at least four inches in diameter, wherein said duct has an inlet end portion, an outlet end portion, and a central portion joining said inlet end portion with said outlet end portion, and a length defined from said inlet end portion through said central portion to said outlet end portion, wherein said duct has a cross section which is essentially constant throughout said length, and wherein said central portion has an opening in said wall;

a rotatably driven fan blade means, which is mounted to said duct and which projects through said opening, for inducing an induced air flow through said duct from said inlet end portion to said outlet end portion to transport said loose fill packing material, wherein air flow into said inlet end portion is equal to air flow out of said outlet end portion;

a screen means within said duct, said screen means contoured so as to be substantially concentric with said fan blade means to prevent contact of said loose fill packing material with said fan blade means without interfering with said induced air flow;

a shroud means attached to said outlet end portion of said duct, said shroud means provided with a plurality of perforations; and a collection means releasably attached to said shroud means for retaining said loose fill packing material as separated from said induced air flow flowing through said perforations in said shroud;

wherein said fan blade means extends into said duct a distance no greater than two inches to establish said induced air flow while maintaining a gap between said fan blade means and said duct wall of at least six square inches to prevent clogging of said gap by said loose fill packing material moving through said duct.

15. The device of claim 14 further comprising:

a housing means enclosing said blade means, said housing means attached to an external surface of said duct; and a handle means attached to said housing means for grasping by a user of said device.

* * * * *